United States Patent [19]

Larsen

[11] 4,044,422

[45] Aug. 30, 1977

[54] SWEEPER PICKUP HOOD WITH AIR LOCK

[75] Inventor: Gregory J. Larsen, Claremont, Calif.

[73] Assignee: FMC Corporation, San Jose, Calif.

[21] Appl. No.: 647,521

[22] Filed: Jan. 8, 1976

[51] Int. Cl.[2] ..... A47L 5/14

[52] U.S. Cl. ..... 15/340; 15/346; 15/348; 15/354

[58] Field of Search ..... 15/340, 345, 346, 348, 15/354

[56] References Cited

U.S. PATENT DOCUMENTS

| | | | |
|---|---|---|---|
| 3,491,399 | 1/1970 | Dolan et al. | 15/354 X |
| 3,512,206 | 5/1970 | Young | 15/346 |
| 3,837,038 | 9/1974 | Kimzey et al. | 15/340 X |
| 3,872,540 | 3/1975 | Block | 15/345 |

*Primary Examiner*—Christopher K. Moore
*Attorney, Agent, or Firm*—C. E. Tripp

[57] ABSTRACT

A street sweeper with an air recirculation type pickup hood includes a vehicle mounted hopper, a blower and a debris pickup hood extending transversely across a swept surface. The blower withdraws air from the hopper and delivers it to one end of the hood and an air stream and entrained debris leave the other end of the hood through an air return line connected to the hopper. Relatively narrow surface engaging sealing flaps extend along the front and rear sides of the hood. At one end of the hood an air lock is provided having a pair of sequentially operating air lock doors for admitting large articles of debris such as cans or bottles that are windrowed to the entrance of the air lock by an angled deflector.

13 Claims, 11 Drawing Figures

FIG_10
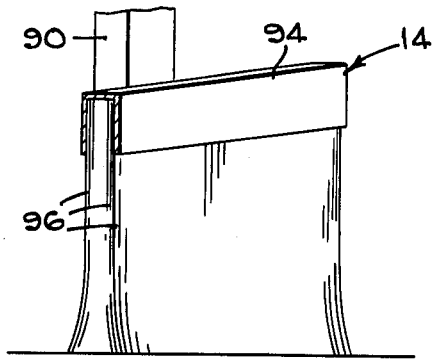
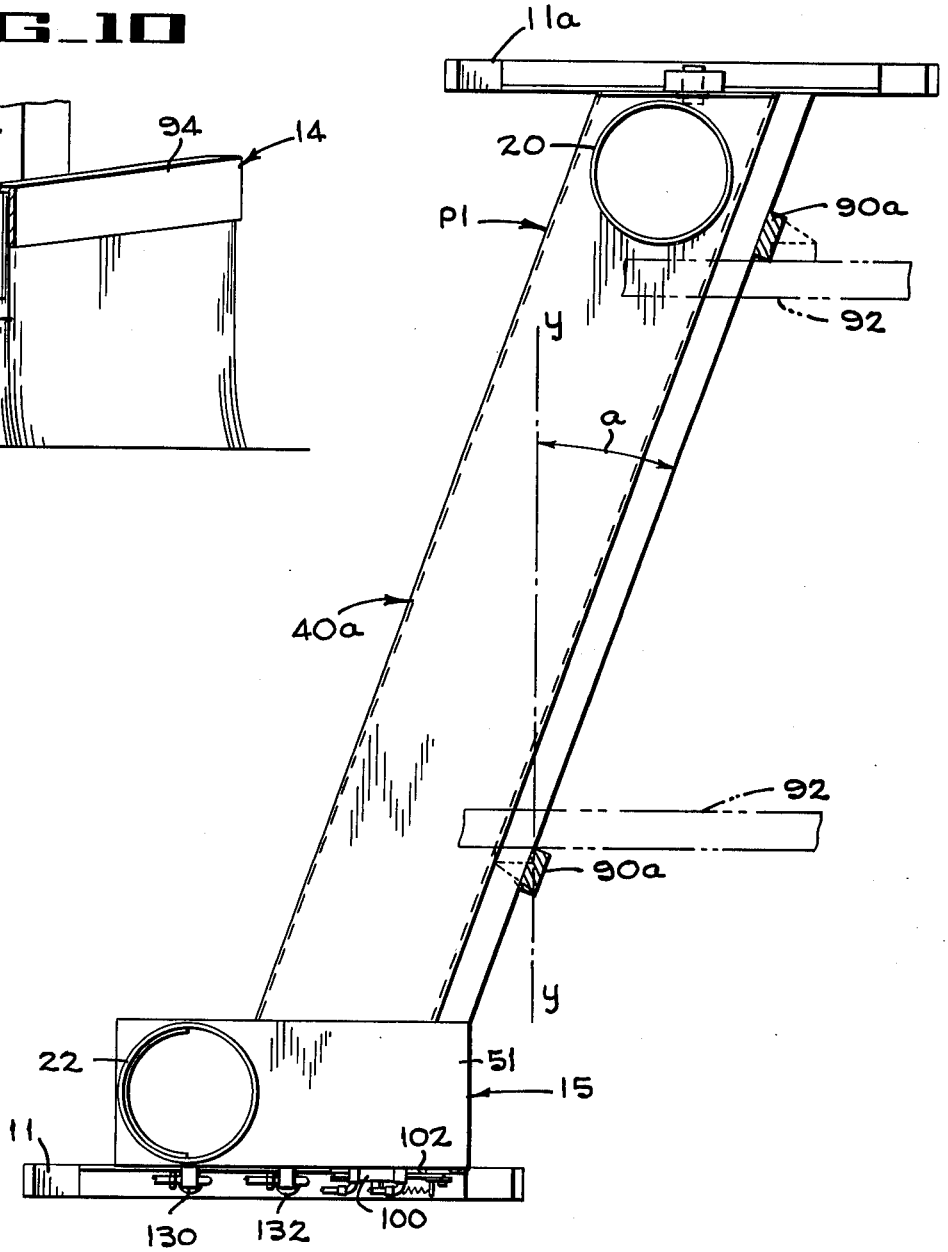
FIG_11

SWEEPER PICKUP HOOD WITH AIR LOCK

DESCRIPTION OF PRIOR ART

Prior art sweeping machines which are directed to the problem of minimizing air loss or air influx into the pickup hood are generally of two types (1) those machines using multiple curtains to more effectively seal the pickup hood to the swept surface, and (2) machines wherein the pickup hood incorporates a driven paddle wheel having flexible blades to augment the pickup of large articles of debris, wherein the blades make sealing engagement with curved walls of the hood.

A multiple curtain system is disclosed in the United States Block U.S. Pat. No. 3,872,540 issued Aug. 7, 1973. The pickup head therein disclosed employs air under pressure in a primary exhaust chamber to sweep across the underside of the pickup head and loosen and remove debris from the swept surface. In order to prevent air and dust from leaking out from under the flexible curtain which normally seals the trailing side of the pickup head, but which inevitably leaks air when the pickup head moves over an uneven surface or over large debris, the system employs a secondary exhaust chamber which includes a portion extending along the trailing end of the primary exhaust chamber. A flexible curtain, parallel to the curtain sealing the trailing end of the primary exhaust chamber seals the trailing end of the secondary exhaust chamber. Thus, if the primary exhaust chamber sealing curtain leaks air and dust under its trailing sealing curtain in traversing an uneven surface or in moving over large debris, the dual curtain arrangement provided by that sealing curtain and the secondary exhaust chamber sealing curtain spaced parallel thereto prevent the air and dust from escaping the pickup head, provided that both sealing curtains are not simultaneously unsealed from ground-contact.

The U.S. Pat. 3,837,038, of Kimzey Sept. 24, 1974, discloses a non-recirculating or vacuum type pickup hood which includes an elongate, open bottom housing. The front wall of the housing is sealed by a laminated flexible flap assembly which has a vertical width large enough to admit large articles of debris and which is vertically slit to minimize the opening provided by the flaps upon the admission of large articles of debris. A driven paddle wheel extends the full length of the housing and is mounted for rotation about an axis transverse to the line of travel. The paddle wheel has flexible flaps projecting from a large diameter tube. The housing, which is vacuumized, has arcuate wall portions which cooperate with the paddle wheel blades to substantially seal the upper portion of the hood (connected to a blower) from the lower, pickup portion of the hood while the blades at the front sector of the wheel are lifting and throwing debris upward into the housing.

SUMMARY OF THE INVENTION

The present invention is illustrated and described in connection with an air recirculation type pickup but it is to be understood that under the broader aspects of the invention, a vacuum-type pickup hood could be employed. Hoods of the type to which the present invention relates have a duct or chamber that is carried by a vehicle over a surface to be swept. In the air recirculation type of hood, the hood has an air inlet line leading from a blower and an air return line directing air entraining debris to the hopper of the vehicle that mounts the hood. It is essential that the hood make an air seal with the swept surface and the conventional method of establishing such a seal is to provide flexible flaps on at least the front and rear walls of the hood. The ends of the hood are commonly supported on the skids which support most of the weight of the hood.

The walls that mount the flaps stop short of the swept surface and the flaps bridge a gap between the lower edges of these walls and the surface. Under many sweeping conditions, the sweeper pickup hood of the type referred to must not only pickup dust, debris and leaves but it also encounters larger objects such as rocks, pieces of wood, cans and bottles. In order to prevent these objects from merely being pushed ahead by the pickup hood, the sealing flaps, particularly those along the front wall of the hood, must be formed so as to accommodate entry of the large articles of debris into the hood for pickup by the air stream flowing from the hood into the hopper of the sweeper. These conditions place two requirements on the design of the hood and the aforesaid flaps. First of all, at least the front wall of the hood must be spaced far enough from the swept surface to admit the aforesaid larger types of debris. This, in turn, would mean that the flaps would be relatively wide in their vertical dimension and must be flexible enough to be lifted by the articles of debris as they enter the hood. The aforesaid lifting action of large articles of debris on a relatively large flexible flap opens up a triangular portion of the flap which in turn opens and provides a relatively large area for the flow of air from the atmosphere into the hood. If a vacuum hood is employed, the action of large articles of debris just described reduces the effectiveness of the vacuum pickup action. If an air recirculation type of hood is employed, such as that employed in the present application, this opening of the hood flaps for large articles of debris can result in air puffing out from under the hood flaps, thereby creating undesirable swirls of dust around the hood.

In accordance with the present invention, the front and rear walls of the hood can be relatively close to the swept surface, because they need not accommodate large articles of debris entering the hood. Also, the hood flaps, which are considerably narrower than prior hood flaps with pickup hoods of the type to which this invention relates, are inherently less flexible than the wide flaps previously employed and can be made of somewhat stiffer material. This hood flap design provides a more effective air seal with the swept surface than that of prior designs.

In order to admit large articles of debris into the hood while maintaining and without interfering with the desired air flow and pressure conditions within the hood, an air lock is provided in the form of a tunnel that leads to the interior of the hood and is fitted with two sequentially opening air lock doors. Deflector means are provided in front of the hood that engage the swept surface to windrow large articles of debris into the aforesaid airlock tunnel. Thus, large articles of debris are admitted to the hood without opening it to the atmosphere, as in the case of wide, flexible flaps and the hood itself is provided with relatively narrow, stiff flaps that make a good seal with the swept surface.

Furthermore no air lock parts are disposed within the pickup hood proper so that there is no interference with air flow into and out of the hood. In the preferred embodiment of the invention, the hood is of the air recirculation type previously mentioned. In this embodiment, the pickup hood is in the form of a duct-like box that extends transversely to the vehicle. Air is admitted to one end of the hood, flows through the hood and leaves the hood by means of an air return line at the other end of the hood. The air lock tunnel is at the air return line end of the hood and the deflector directs large articles to the entrance of that tunnel. In the preferred embodiment of the invention, the hood extends transversely and generally perpendicularly to its path of motion across the swept surface. The deflector is in the form of a blade or brush that diverges from the air lock tunnel entrance forwardly and outwardly away from the hood, so as to windrow large articles into the air lock tunnel.

In another form of the invention, the deflector and hood can be combined in a single unit by disposing the hood at an angle so that the front wall of the hood itself acts as a deflector to windrow articles into the air lock tunnel.

To briefly characterize the invention in its broader terms, the invention comprises a street sweeper of the type having a vehicle mounted hopper, a blower and a debris pickup hood extending transversely across a surface, with an air return line for delivering air entrained debris to the hopper. The hood has narrow flexible surface engaging sealing flaps and comprises a tunnel having a forwardly opening entrance for admitting large articles of debris to the interior of the hood. The tunnel includes an air lock means for accommodating the passage of large articles of debris through the tunnel while maintaining an air seal between the tunnel and the interior of the hood. Air lock operator means are provided for cyclically opening and closing the air lock means and a deflector is provided for engaging the swept surface and windrowing large articles of debris into the entrance of the tunnel.

BRIEF DESCRIPTION OF THE DRAWINGS

FIG. 10 is a section through the deflector taken on line 10—10 of FIG. 2.

FIG. 11 is a plan view of a modified form of the invention.

DESCRIPTION OF THE PREFERRED EMBODIMENT

SWEEPER INSTALLATION

Figure 1:
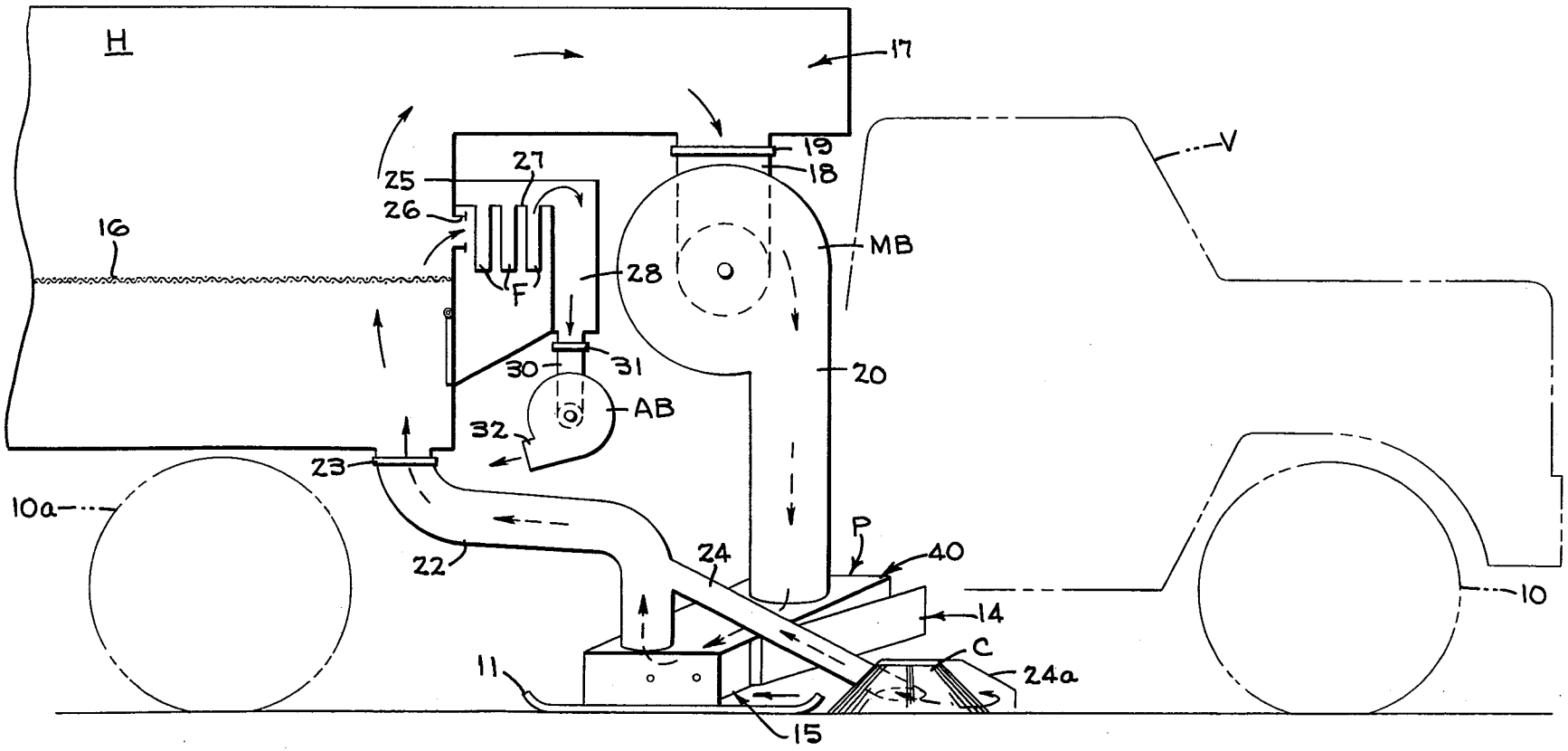
FIG. 1 is a schematic diagram showing the air flow system of the street sweeper embodying the present invention.

Before describing the improved pickup hood and air lock system of the present invention, the mode of operation of a sweeper system embodying the invention will be summarized in connection with the diagram of FIG. 1, which is a highly schematic diagram indicating the flow pattern in the air system of a sweeper embodying the hood of the present invention.

The sweeping system is mounted on a mobile vehicle V, which may be a converted truck chasis, the chassis being signified by the front and rear wheels **10, 10*a*. The sweeping system includes a main debris pickup unit in the form of a pickup hood P embodying the present, which is mounted on the chassis and provides a transversely mounted duct-like housing, which forms the subject matter of the copening application of Larsen et al, Ser. No. 647,305, filed Feb. 5, 1976, entitled Unidirectional Flow Pickup Hood For Street Sweepers, and assigned to the FMC Corporation. The hood has surface engaging skids 11 and 11*a* (FIGS. 3 and 6) at each end and has surface engaging flaps, which will be described presently. The air flow system shown in FIG. 1** forms the subject matter of the copending application of Larsen, Ser. No. 647,485, filed Jan. 8, 1976, now U.S. Pat. No. 4,006,511 issued Feb. 8, 1977 entitled Sweeper With Recirculation Hood And Independent Filter System, assigned to the FMC Corporation.

The sweeping hood P is mounted on the vehicle chassis by a trailing link suspension in a manner known in the art and described in the aforesaid copending application of Larsen. Associated with the hoop P is a deflector 14 11, angled forward from said hood, which windrows large articles, such as cans or the like, laterally to an air lock system indicated generally at 15, wherein the articles are admitted to the hood P through alternately opening pivoted doors **15*a* and 15*b* (FIG. 4) without opening the hood to the ambience. The deflector 14 and the air lock system 15** form the subject matter of the present invention.

Mounted on the vehicles chassis is a debris hopper H. This hopper is a box-like structure that can be elevated about a rear pivot on the vehicle frame (not shown) to discharge accumulated debris through a rear hopper door, as described in detail in the aforesaid copending Larsen application, Ser. No. 647,485, filed Jan. 8, 1976 now U.S. Pat. No. 4,006,511 issued Feb. 8, 1977.

The hopper H is fitted with a screen 16 to filter out coarse debris and one side of the hopper is formed with a forwardly projecting air exhaust chamber 17 which, during the sweeping operation, connects with the inlet 18 of a main blower MB, by means of a sealing gasket 19 that permits lifting of the hopper. The main blower withdraws air from the hopper and delivers it to one end of the pickup hood P by an air delivery or inlet line 20. An air return line 22 is connected between the end of the hood duct at the air lock 15 and the bottom of the hopper H through a sealing gasket 23 that permits tilting of the hopper. The air return line 22 draws a debris laden air stream into the hopper. In the embodiment shown, a suction line 24 is connected to the air return line 22, and the line 24 exhausts air and dust from within a shroud 24a that partially surrounds a curb brush C.

A front wall or partition 25 of the hopper H is formed with an opening 26 which communicates with a compartment containing a filter assembly for filtering out fine particles. The filter system comprises a series of tubular, porous filter elements F depending from a partition 27. Preferably, the filter elements are constructed in accordance with the principles of the copending application of Groh Ser. No. 602,275, filed Aug. 13, 1975, now U.S. Pat. No. 4,006,511 entitled Compact Dust Filter System and assigned to the FMC Corporation. However, the details of the filter system for fine debris are not critical to the present invention. Air is drawn through the porous walls of the filter elements, depositing dust on their exterior surfaces. Filtered air is drawn out through the open upper ends of the filter into a filtered air chamber 28, which is connected to the inlet 30 of an auxiliary blower AB, through a separable sealing gasket 31. The exhaust 32 of the auxiliary blower delivers filtered air to the atmosphere.

HOOD CONSTRUCTION

Figure 2:
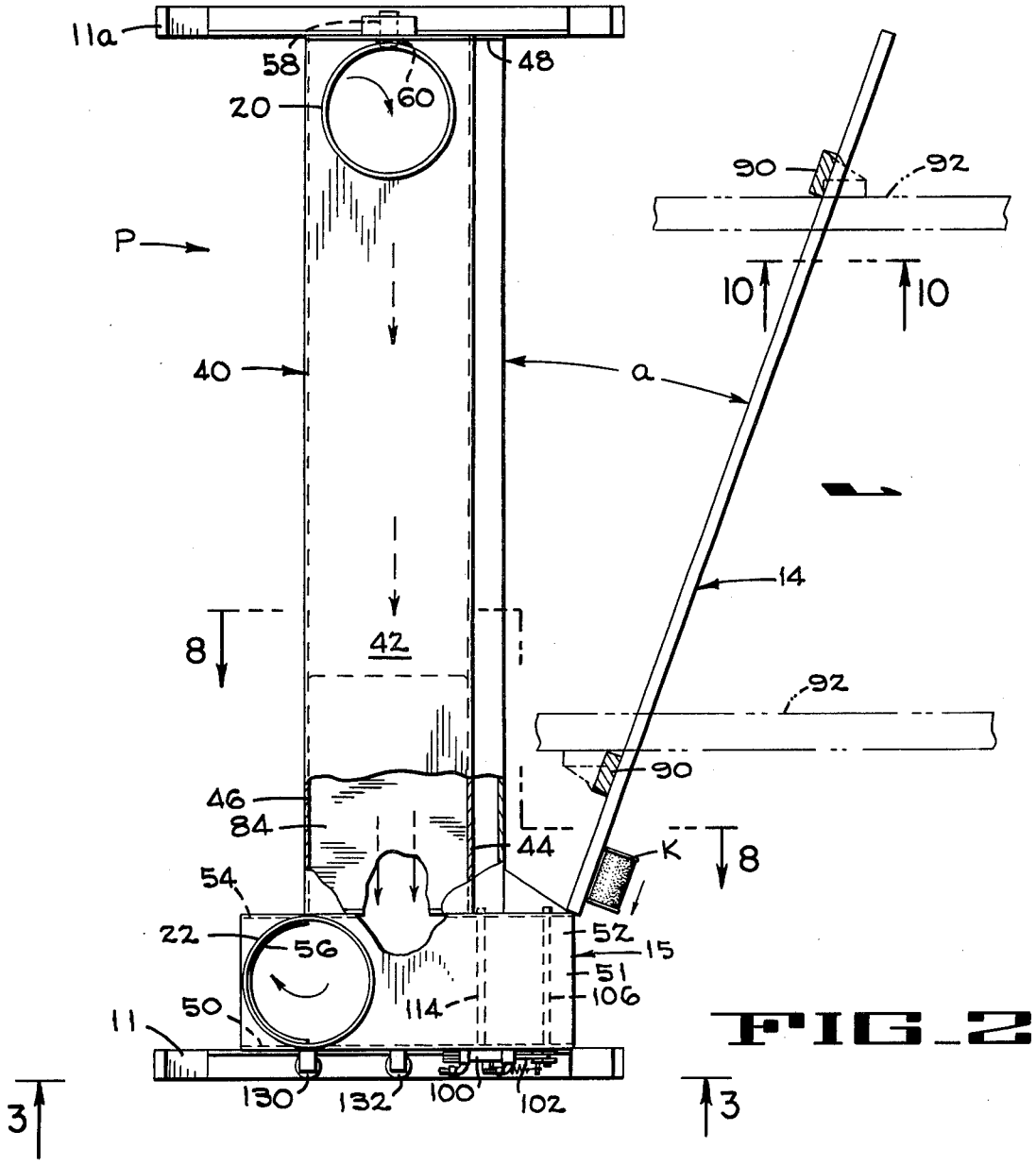
FIG. 2 is a plan view of a pickup hood embodying the invention, with parts broken away.
Figure 3:
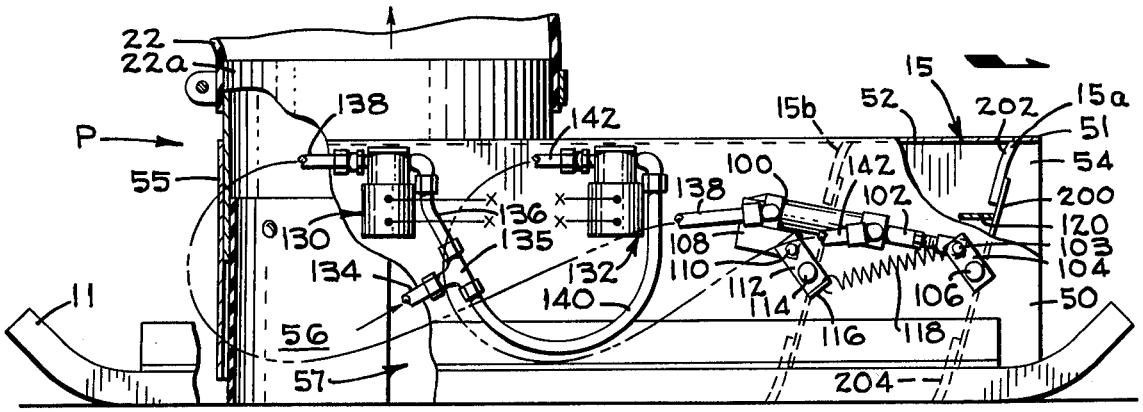
FIG. 3 is a side elevation looking along line 3—3 of FIG. 2.
Figure 8:
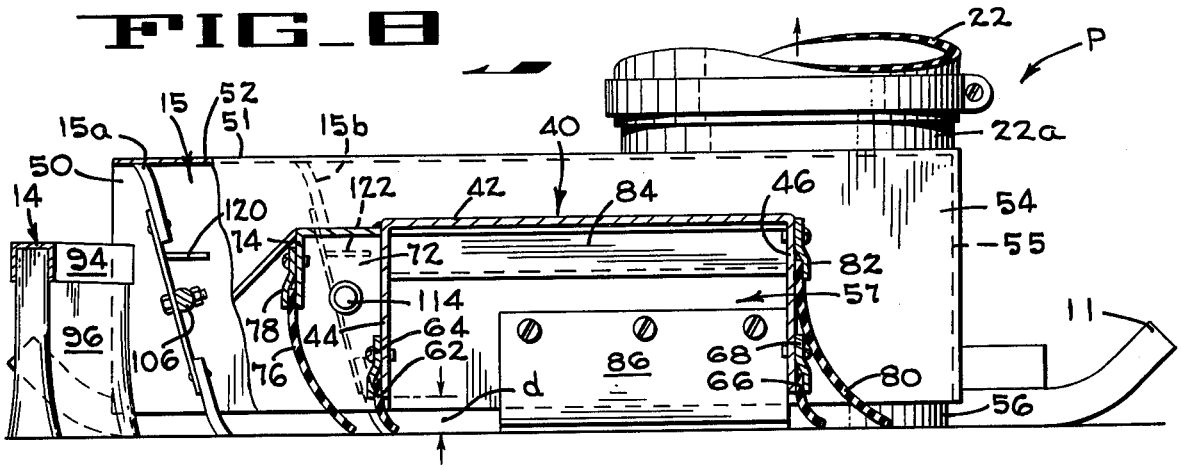
FIG. 8 is a section taken along the line 8—8 of FIG. 2 showing the interior of the hood, with parts broken away.

Referring to FIGS. 2, 3 and 8, the pickup hood P of the present invention embodies an elongate rectangular duct indicated generally at 40. The duct has a top wall 42, a front wall 44 (the motion of the hood along the surface being indicated by a large arrow on several of the figures) and a rear wall 46.

The ends of the duct are closed by an end wall 48 adjacent the air inlet line 20 and an end wall 50 adjacent the air return line 22. The end wall 50 forms the outer side of a tunnel 51 forming part of the air lock system 15 to be described presently. The end walls 48 and 50 mount the skids 11*a*, 11 which engage the swept surface and form seals for the ends of the duct. The air lock tunnel 51 communicates with the duct 40 and has a top wall 52, and an inside wall 54 which joins the end of the duct 40, but which is cut away to conduct air from the duct 40 into the tunnel 51 and out the air return line 22 (FIG. 8), as seen in FIGS. 2 and 3. The side walls 50, 54 of the air lock tunnel 51 and its top wall 52 are closed by a rear wall 55 (FIG. 3). The lower end of the air return line 22 is formed as a short tubular duct 22*a* welded to the top wall 52 of the tunnel. A semi-circular baffle 56 (FIGS. 2 and 3) is fastened to the duct 22*a* and extends down to the swept surface, as shown in FIG. 3. The front of the air lock tunnel is open and is closed by sequentially opening doors or flaps 15*a*, 15*b*, as will be described in detail presently. The delivery end of the air lock tunnel and the downstream end of the duct 40 join in a common chamber 57 from which the air stream is withdrawn through the air return line 22.

As seen in FIG. 2, the skid 11a is pivotally mounted on the end wall 48 of the duct. The skid is welded to a stub shaft 58 which is pivotally mounted in the end wall 48 and is retained by a lock nut 60 that is adjusted to allow pivotal motion of the skid. This construction facilitates maintaining engagement of the flaps, to be described presently, with the swept surface when the hood is dragged over irregular surfaces.

As seen in FIG. 8, the front wall 44 of the duct 40 has relatively short ground engaging flaps 62, retained by a clamp strip 64 screwed to the front wall 44. These flaps are formed of a flexible material, as is known in the art and preferably formed of an extruded elastomeric strip that is about 3/16 inches thick. Similar flaps 66 are secured to the rear wall 46 of the duct 40 by a clamp strip 68. It is noted that the flaps 62, 66 that seal the front of rear walls of the duct 40 are relatively narrow in their vertical dimensions. The duct flaps 62, 66 can be made shorter or narrower than usual in systems of this type because the deflector and air lock systems of the present invention admits large articles of debris, which articles need not pass under the front wall 44 and its flap 62 in order to be picked up and delivered to the air return line 22. In fact, the front and rear walls 44, 46, of the duct 40 need only be spaced a distance *d* (FIG. 8) from the ground of about two inches, thereby making the flaps stiffer and less apt to be lifted from the swept surface than the flaps of the conventional pickup hoods.

In order to provide an air lock effect for small particles of debris that pass under the deflector brush 14, a dead air chamber 72 (FIG. 8) is provided at the front of the duct 40. This dead air chamber is formed by an angle iron 74 welded to the upper portion of the front side wall 44 of the duct 40. The angle 74 mounts a relatively long flexible flap 76 clamped to the angle by a clamp strip 78. Air is not circulated through the chamber 72 but the relatively flexible flap 76 forming the front wall of that chamber operates in conjunction with the flap 62 of the duct 40 to admit small particles of debris to the duct without puffing of dust to the atmosphere from within the duct. A flexible flap 80 (FIG. 8), which is clamped to the rear side wall 46 of the duct 40 by a clamp strip 82, augments the seal provided by the main flap 66 for the duct.

As previously mentioned, as air flows through the duct 40 from the air inlet line 20 to the air return line 22, and the air stream flowing through the hood is progressively accelerated and flattened as it approaches the air return line 22 by results, a simple deflector or accelerating plate 84 (FIGS. 2 and 8) mounted within the hood and which extends downwardly from a position upstream of the air return line to its lowermost position at the air return line. The duct and deflector plate conduction just described forms the subject matter of the aforesaid Larsen et al application, Ser. No. 647,305.

In order to minimize the dropping out of debris due to centrifugal force, when a portion of the air stream reaches the outside side wall 50 of the air lock tunnel (FIG. 8), a flexible curved baffle 86 is secured to the side wall 50 and makes sealing engagement with the swept surface. This baffle, which is not critical to the present invention and which is described in detail in the aforesaid Larsen et al application, minimizes dropout due to abrupt changes in direction of the air stream at the downstream corner of the pickup hood.

The manner in which the deflector 14 is mounted is not critical to the present invention. In the form shown and as seen in FIG. 2, the deflector 14 is suspended by vertical bars 90, which bars are twisted and secured to frame members 92 of the sweeper vehicle V. The deflector 14 is stiff enough to windrow larger articles of debris into the air lock tunnel 51 previously described. As shown in FIG. 10, one preferred construction of the deflector is in the form of a brush, having a brush retaining clip strip 94 mounting bristles 96.

AIR LOCK DOOR OPERATION

Figure 9:
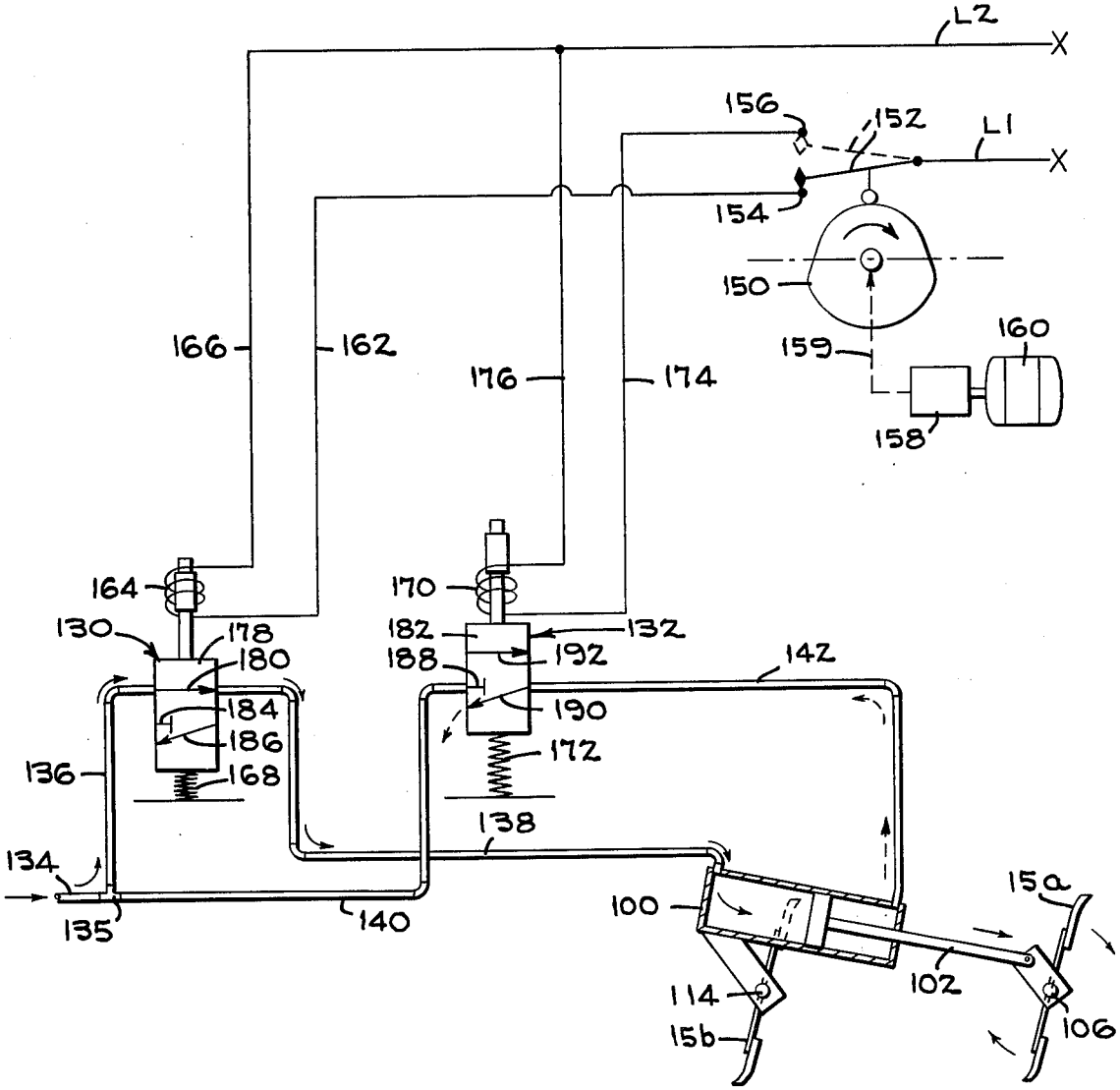
FIG. 9 is a schematic diagram of the sequencing means for the air lock doors.

FIG. 3 shows the airlock door operating piston and the solenoid valves that control the piston. FIG. 9 is a diagram of a mode controlling the solenoid valves and FIGS. 4–7 are operational views showing the sequence of operations.

Referring to FIG. 3, the mechanism for sequentially opening and closing the air lock doors or flaps 15*a*, 15*b* is a double acting piston cylinder assembly controlled by two solenoid air valves. In the preferred embodiment, the operating mechanism includes a piston 100 and a piston rod 102 which is pivotally connected at 103 to a crank arm 104. The crank arm 104 connects to a shaft 106 which mounts the front air lock door 15*a* and extends between the side walls 50 and 54 of the air lock tunnel 15, as seen in dotted lines in FIG. 2. The rear end of the cylinder 100 is fixed to a plate 108 that is pivoted at 110 to a crank arm 112 for the shaft 114 of the rear air lock door 15*b*. The crank 112 has an extension that provides a foot 116 on the opposite side of the shaft 114 from the pivot 110 for the crank 112. A spring 118 extends between the foot 116 and the pivot 103 of the crank 104. A fixed stop 120 is provided in the upper portion if the air lock tunnel 51 for limiting closing motion of the front air lock door 15*a*. A similar stop 122 is provided for limiting the closing motion of the rear air lock door 15*b* (FIG. 8).

The control for the piston and cylinder assembly 100, 102 is provided by solenoid valves 130, 132, arranged as shown in FIG. 3. A common air supply line 134 which receives air under pressure from an air compressor (not shown) driven by any convenient means from a prime mover on the vehicle. The manner in which air is supplied to the line 134 is not critical to the present invention. The air supply line 134 connects to a Tee 135 which feeds a supply branch 136 for directing air to the solenoid valve 130. The solenoid valve 130 has an air line 138, shown partially in phantom in FIG. 3, for directing air under pressure to the piston end of the cylinder 100. The pipe Tee 135 has a second branch 140 that delivers air to the solenoid valve 132 and the latter valve is connected by a line 142 to the rod end of the cylinder 100.

The manner in which the solenoid valve 130, 132 are controlled and how they operate are schematically illustrated in the diagram of FIG. 9. It is understood that the timing system for controlling these valves is not critical to the present invention and that the control of FIG. 9 represents schematically a system which will produce the desired function. A cam 150 operates a double throw switch contact 152 connected to the power line L1. The other power line is indicated at L2 and these lines are connected to a source of (direct) current, such as a battery mounted on the sweeper vehicle. The cam 150 is so arranged that contacts 154 are closed during 180° rotation of the cam and during the second 180° rotation, the contacts 154 are opened and the contacts 156 are closed.

The drive for the cam 150 is illustrated schematically in FIG. 9 and includes a gear box 158 that is mechanically connected by transmission device or shaft 159 to the cam 150. The gear box 158 is driven by a device which may be an electric motor 160 or a drive taken from the prime mover on the sweeper vehicle. The contacts 154 of FIG. 9 connect line L1 to a line 162 leading to a solenoid 164 in the valve 130. The return line 166 on the solenoid 164 connects to the line L2. When the solenoid 164 is energized, as indicated in the position of the parts shown in FIG. 9, the valve is shifted to the position shown in that diagram against the force of a spring 168.

The valve 132 which operates the rod end of the cylinder assembly 100, 102 has a solenoid 170. The solenoid is de-energized in the position shown in FIG. 9 and the valve is shifted to the position of FIG. 9 by a spring 172. The solenoid 170 is connected to the contact 156 by a line 174 and to the power line L2 by a line 176.

In the position of the parts shown in FIG. 9 with the solenoid 164 energized by the contact 152, the valve element 178 of the valve 130 is positioned against the force of spring 168 to bring a valve passage 180 into position to conduct air from an air inlet 134 to the piston end of the piston 100. When the solenoid 164 is de-energized the spring 168 shifts the valve element to a position corresponding to that shown for the valve element 182 of the other solenoid valve 132. In the latter condition, the air line of the air input line 136 to the valve 130 would be blanked off by the blanking passage 184 and the air line 138 connected to the rod end of the piston 100 would be connected to exhaust by the valve passage 186.

Referring back to the other solenoid valve 132 which operates the rod end of the piston, in the position shown the air supply line 140 is blanked off by a blank passage 188 in the valve element 182 and the air line 142 from the rod end of the piston is connected to the exhause by a valve element passage 190. A valve element passage 192 is provided in the element 182 but is not in use at this position.

To summarize the operation of the piston cylinder assembly 100,102 as illustrated by the schematic diagram of FIG. 9 during 180 degrees of rotation of the cam 150 (which can be considered one half of a cycle) the solenoid 164 of the valve 130 is energized and air is directed to the piston end of the cylinder 100 while air is exhausted from the rod of the cylinder through the valve 132. During the other 180° of cam rotation, the contacts 152 engage the fixed contacts 156 and energize the solenoid 170 of the valve 132. Under these conditions the air supply is connected to the rod end of the cylinder through the passage 192 of the valve element 182 and the rod end of the cylinder is connected to the exhaust passage 186 of the valve 130. Thus, rotation of the cam 150 alternately pressurizes the rod and the piston ends of the piston and cylinder assembly 100,182.

Although a mechanically operated switch is illustrated as controlling the solenoid valve functions, it is to be understood that any of the well known types of electronic time delay switching circuits may be emphasized.

OPERATION

The cyclical operating sequence of the air lock system to pass debris from the ambience to the interior of the hood is shown in the schematic diagrams of FIGS. 4 – 7. The means for directing air to the rod end or to the piston end of the piston and cylinder assembly 100,102 have been previously described in detail relative to the schematic of FIG. 9 and will not be repeated in the description of FIGS. 4 – 7 that follows.

Figure 7:
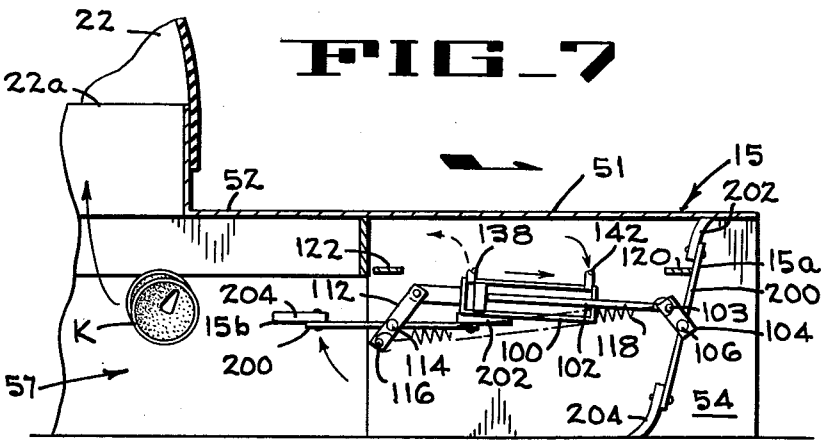
Figure 4:
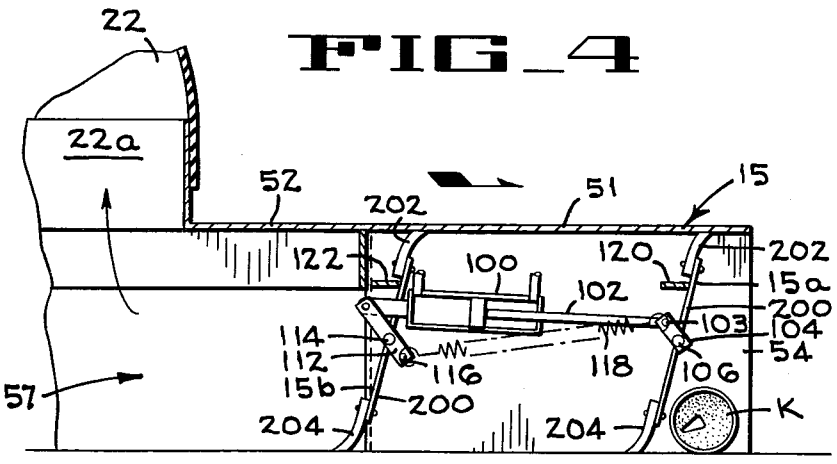

The position of the elements in FIG. 4 illustrates what can be considered to be either an at rest position when no air is supplied to either of the air lines 138,142 leading to the piston 100, or it can be considered to represent an instantaneous condition during operation that would follow the conditions shown in the diagram of FIG. 7.

In FIG. 4, the piston on the rod 102 is centralized in the cylinder 100 and the spring 118 acting on the crank 104 and the crank extension 116 has brought the doors or flaps 15*a*,15*b* against their respective stops 120,122. The air lock is now closed and sealed off from the chamber 57 and the air return line 22. It is to be noted that the flaps or doors 15*a*, 15*b* are each formed with a metal body 200 and upper and lower flaps 202,204 that are secured to the metal bodies and are formed of a flexible material such as rubberized fabric or the like.

The deflector 14 is not shown in FIGS. 4 – 7 but it will be assumed that a can K such as that shown in the plan view of FIG. 2 will have worked its way into the inlet of tunnel 51 and is disposed adjacent the inlet door 15*a* for the airlock tunnel, as shown in FIG. 4.

Figure 5:
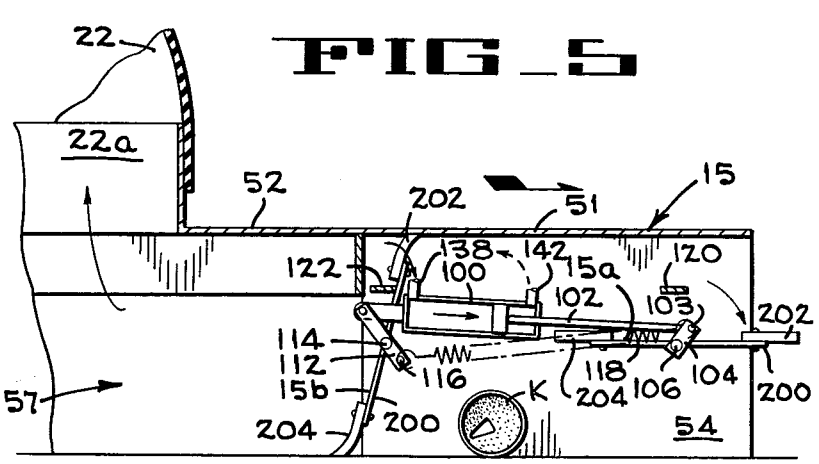
FIGS. 4–7 are schematic diagrams illustrating the operational sequence of the air lock system.

In the diagram of FIG. 5, the front door 15*a* has been opened and the can K has been admitted to the air lock tunnel. The rear door 15*b* remains closed so that an air seal is provided between the ambience, and the chamber 57 and the air return line 22. The action of FIG. 5 is provided by introducing air through the air line 138 to the piston end of the cylinder 100 and exhausting air through the line 142 from the rod end of the cylinder. The aforesaid action extends the piston 102 and turns the crank 104 opening the front door 15*a*. There is a reaction occurring against the cylinder 100 urging it to the left in FIG. 105, which reaction operates through the crank 112 to hold the rear door 15b in its closed position against the stop 122. It is noted that opening of the front door in the manner just described stretches the spring 118.

Figure 6:
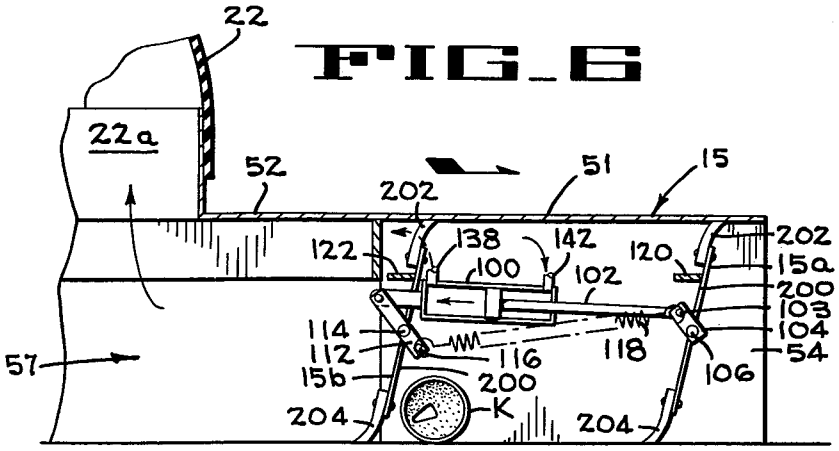

In the diagram of FIG. 6, the pickup hood, along with the airlock tunnel 51 have continued their advance in the direction of the large arrow and the can K and has approached the rear door 15*b*. In the position of FIG. 6, air has been admitted through the line 142 to the rod end of the piston 102, thereby retracting the piston to its intermediate position like that shown in FIG. 4. Thus action of the air coupled with the force of the spring 118 acting on the crank 104, has closed the front door 15*a*. Thus, an air seal is maintained in the air lock tunnel 51.

In the position of FIG. 6, the piston end of the cylinder is connected to exhaust of the line 38 through the valve system previously described in connection with the diagram of FIG. 9.

FIG. 7 shows the condition wherein the front door 15*a* remains closed with the rear door 15*b* opened, admitting the can K to the influence of the air stream circulating through the duct 40 of the pickup hood to the chamber 57, with the can being lifted, ready to be drawn through the air return line 22 into the vehicle hopper. In FIG. 7, air has been admitted through the line 142 to the rod end of the piston 100. However, since the front door 15*a* is held against the stop 120 the piston cannot move to the left and the air pressure in the line 142 causes advance (motion to the right) of the cylinder 100. Air is exhausted from the piston end of the cylinder through the line 138 to the atmosphere, as described in connection with diagram FIG. 9. When air is introduced into the line 142, as shown in FIG. 7, and when the piston 100 is forced to the right, the connection of the piston to the crank 112 opens the rear door 15*b* against the force of the spring 118, thereby admitting the can K to the chamber 57 at the rear end of the air lock tunnel 51 as previously described.

Continued rotation of the cam 150 of FIG. 9 from the position which produces the conditions shown in FIG. 7 will introduce air under pressure to the piston end of the cylinder 100 through line 138 and exhaust the rod end through line 142 restoring the two doors to their closed position shown in FIG. 4.

With a sweeper moving across a swept surface at a rate of about 2 – 10 miles per hour, the structure of FIG. 9 that operates the solenoid valves 130,132 is timed so that a complete cycle from the position of FIG. 4 where both doors are closed, to the position of FIG. 5 where the front door is open and the rear door is closed, to the position of FIG. 6 where both doors are again closed, to the position of FIG. 7 wherein the front door is closed and the rear door is opened, and back to the position of FIG. 4 in about 2 – 10 seconds cycle time independent of the forward speed of the sweeper.

Thus, with the pickup and airlock construction of the present invention, the flaps of the duct can be made relatively short and stiff to optimize the seal of the duct against swept surface (FIG. 8) and large articles of debris can be admitted for entrainment in the air stream and delivery to the hopper as shown in the schematic diagrams of FIGS. 4 – 7.

MODIFIED FORM

FIG. 11 shows a modified form of the invention which has the same mode of operation as that previously described, except that a separate deflector 14, such as that shown in FIG. 2, is not required.

In FIG. 11, the pickup hood P1 is inclined from a line $y - y$ that is perpendicular to the vehicle frame elements 92 by an angle $a$ of 35°, which also represents the preferred angle of inclination of the deflector 14 shown in FIG. 2. The recirculation duct 40a is constructed like the duct 40 previously described and in the construction illustrated the hood P1 is suspended from the frame elements 92 by brackets 90*a*. However, the details of the suspension of the pickup hood P1 are not critical to the invention and a conventional trailing arm construction, like that commonly employed in the art, can be substituted for the brackets 90*a*. The ends of the pickup hood P1 are supported on skids 11 and 11*a* as previously described. The air lock structure 15 and the tunnel 51 includes a pair of sequentially operating doors and mechanism for operating them like the construction described in conjunction with the preferred embodiment. In operation, the front of the duct 40*a* operates as a deflector and windrows large articles of debris into the air lock tunnel 51 for disposal while maintaining the seal, as previously described.

Although the best mode contemplated for carrying out the present invention has been herein shown and described, it will be apparent that modification and variation may be made without departing from what is regarded to be the subject matter of the invention as defined in the appended claims.

I claim:

1. In a street sweeper of the type comprising a vehicle mounted hopper, a blower and debris pickup means comprising a hood extending transversely across the swept surface; said hood having an air line for delivering air-entrained debris to the hopper, and flexible, surface engaging sealing flaps; the improvement comprising a tunnel connecting the interior of the hood with ambience having a forwardly opening entrance for admitting large articles of debris, air lock means in said tunnel for accommodating the passage of large articles of debris through said tunnel while maintaining an air seal between the ambience and the interior of said hood, air lock operator means for cyclically operating said air lock means to pass said debris from the ambience to the interior of the hood, said debris pickup means including deflector means engaging the swept surface for windrowing large articles of debris into the entrance of said tunnel.

2. The sweeper of claim 1, wherein said tunnel is disposed at one end of the hood, said deflector means diverging from the tunnel entrance for windrowing large articles of debris into the entrance of said tunnel.

3. The sweeper of claim 2, wherein said deflector means comprises a transverse blade that is angled forwardly from said hood and from said tunnel.

4. The sweeper of claim 2, wherein said hood has a front wall that is angled forwardly from said tunnel for providing said deflector means.

5. The sweeper of claim 1, wherein said air lock means comprises spaced doors pivotally mounted in said tunnel, said air lock operator means including sequencing means for alternately opening and closing said doors.

6. The sweeper of claim 1, wherein said air lock operator means includes timing means for cyclically operating said air lock means about every 5 – 15 seconds.

7. In a street sweeper or the like which comprises a vehicle carrying a debris hopper, blower means for withdrawing air from the hopper, debris pickup means comprising a hood having an air inlet line connected to the outlet of said blower means and an air return line for delivering air and entrained debris to the hopper, said hood comprising a box like structure forming an air stream duct that extends generally transverse to the vehicle, sealing flaps along the front and rear sides of said hood, said air lines being connected to opposite end portions of the hood; the improvement in said hood, wherein said hood is constructed to provide a chamber adjacent the air return line for receiving air-entrained debris from within the hood and large articles of debris from outside the hood, a forwardly opening tunnel leading to said chamber and providing an entrance for large articles of debris, movable air lock means in said tunnel for accommodating the passage of articles through the tunnel while maintaining an air seal between the ambience and said chamber, and air lock operator means for cyclically operating said air lock means to pass said debris from the ambience to said chamber, said debris pickup means including a deflector for windrowing large articles of debris into the entrance of said air lock tunnel.

8. The sweeper of claim 7, wherein said deflector means comprises a transverse blade that is inclined forwardly from the entrance to said tunnel.

9. The sweeper of claim 7, wherein said hood has a front wall that is angled forwardly from the entrance to said tunnel for providing said deflector means.

10. The sweeper of claim 7, wherein said air lock means comprises spaced doors pivotally mounted in said tunnel, said air lock operator means including sequencing means for alternately opening and closing said doors.

11. The sweeper of claim 7, wherein said air lock operator means includes timing means for cyclically operating said air lock means about every 5 – 10 seconds.

12. The sweeper of claim 7, wherein skids are provided on the ends of said hood for supporting the hood on the swept surface, and means for pivotally mounting one of said skids on the hood.

13. The sweeper of claim 7, wherein said air lock operator means comprises a crank arm connected to each door pivot, a spring connected between said crank arms for urging the doors to their closed positions, a linear actuator connected between said crank arms, and stop means for preventing pivoting of said doors past their closed positions, extension of said linear actuator opening one door while stretching said spring to urge the other door against its stop means, retraction of said linear actuator opening the other door while stretching said spring to urge said one door against its stop means.

* * * * *

UNITED STATES PATENT AND TRADEMARK OFFICE

CERTIFICATE OF CORRECTION

PATENT NO. : 4,044,422

DATED : August 30, 1977

INVENTOR(S) : GREGORY J. LARSEN

It is certified that error appears in the above-identified patent and that said Letters Patent are hereby corrected as shown below:

Col. 4, line 20, change "hoop" to --hood--;
line 21, delete "11";
line 60, delete "4,006,511" and insert therefor --4,007,026 issued February 8, 1977,--.
Col. 6, line 22, after "647,305" insert --now Patent No. 4,006,511--;
line 25, change "outside" to --outer--.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*